US006577331B2

(12) United States Patent
Saito et al.

(10) Patent No.: US 6,577,331 B2
(45) Date of Patent: Jun. 10, 2003

(54) PRINTER

(75) Inventors: Tomoaki Saito, Chuo-ku (JP); Norihiro Nakabayashi, Chuo-ku (JP); Tsutomu Shioya, Chuo-ku (JP)

(73) Assignee: MAX Co., Ltd., Tokyo (JP)

( * ) Notice: Subject to any disclaimer, the term of this patent is extended or adjusted under 35 U.S.C. 154(b) by 0 days.

(21) Appl. No.: 09/926,345

(22) PCT Filed: Feb. 19, 2001

(86) PCT No.: PCT/JP01/01156

§ 371 (c)(1),
(2), (4) Date: Oct. 17, 2001

(87) PCT Pub. No.: WO01/60625

PCT Pub. Date: Aug. 23, 2001

(65) Prior Publication Data

US 2002/0140800 A1 Oct. 3, 2002

(30) Foreign Application Priority Data

Feb. 18, 2000 (JP) ..... 2000-40996

(51) Int. Cl.[7] ..... B41J 11/04; B41J 13/02; B41J 23/02

(52) U.S. Cl. ..... 347/215; 347/218

(58) Field of Search ..... 347/215, 217, 347/218; 400/616, 616.1, 616.3, 611

(56) References Cited

U.S. PATENT DOCUMENTS 4,269,522 A * 5/1981 Levinson et al. ..... 400/616.1
5,986,686 A * 11/1999 Guckin ..... 347/218

FOREIGN PATENT DOCUMENTS

| | | |
|---|---|---|
| JP | 63-231962 | 9/1988 |
| JP | 3-73375 | 3/1991 |
| JP | 3-96374 | 4/1991 |
| JP | 8-80647 | 3/1996 |
| JP | 11-240644 | 9/1999 |

* cited by examiner

*Primary Examiner*—Huan Tran
(74) *Attorney, Agent, or Firm*—Jacobson Holman PLLC

(57) ABSTRACT

A printer comprising a printer main body, a cover, a sprocket for delivering a sheet from a sheet roll, a platen roller used in printing on the sheet, a thermal head for printing on the sheet, a driving gear mechanism for rotating the sprocket platen roller, and a gear mechanism for rotating, by the driving gear mechanism, the ribbon core of an ink ribbon cassette mounted on the cover, the printer main body being provided with the sprocket and platen roller, the cover being provided with the thermal head, wherein the platen roller is disposed downstream of the sprocket and it is arranged that when the cover is closed, the core gear of the ink ribbon cassette meshes with a gear of the gear mechanism to eliminate the backlash of the platen gear.

12 Claims, 15 Drawing Sheets

PRINTER

This is a nationalization of PCT/JP01/01156 filed Feb. 19, 2001 and published in Japanese.

FIELD OF THE INVENTION

The present invention relates to a printer for printing characters and the like indicating a route or location.

BACKGROUND OF THE INVENTION

Conventionally, for example, a printer shown in FIG. 16 is known. The printer shown in FIG. 16 includes a sprocket 1, a platen roller 2, a thermal head 3, a sheet roll 4 on which a sheet is wound. The thermal head 3 is arranged on a cover 5. A ribbon cassette (not depicted) is mounted on this cover 5. Moreover, the cover 5 is mounted on a printer main body 7 in such a manner that the cover 5 can swing around a shaft 6.

The sprocket 1 and the platen roller 2 are arranged in the printer main body 7. A reference symbol 8 denotes a cutter for cutting the sheet. The cutter 8 is arranged in the printer main body 7. A drive gear mechanism for rotating the sprocket 1 and the platen roller 2 is also arranged in the printer main body 7.

In this printer, since the sprocket 1 is arranged downstream of the platen roller 2, a distance W between the thermal head 3 and the cutter 8 is significantly large. This results in a long blank space between the leading edge of the sheet to the position where a character is printed.

This blank space can be reduced by arranging the platen roller 2 downstream of the sprocket 1. However, in this case, to eliminate loosening of the sheet between the platen roller 2 and the sprocket 1, the platen roller 2 should have a circumferential speed slightly larger than the circumferential speed of the sprocket 1 when feeding the sheet.

However, upon printing start, the sprocket 1 starts rotation earlier than the platen roller 2 because of backlash and the sheet is loosened between the platen roller 2 and the sprocket 1. Thus, when the platen roller 2 has a fast circumferential speed, the feed-direction length is undesirably increased. That is, the printing distance accuracy becomes unstable.

SUMMARY OF THE INVENTION

It is therefore an object of the present invention to provide a printer comprising a printer main body, a cover arranged on the printer main body in such a manner that the cover can be opened, a sprocket for feeding a sheet from a sheet roll arranged in the printer main body, a platen roller for printing on the sheet, a printing head for printing on the sheet, a driving gear mechanism for rotating the sprocket and the platen roller, and a gear mechanism for rotating a ribbon core of an ink ribbon cassette mounted on the cover using the driving gear mechanism, wherein the sprocket and the platen roller are arranged in the printer main body, the printing head is arranged on the cover, and the platen roller is arranged downstream of the sprocket with respect to the forward conveying direction of the sheet, and wherein backlash eliminating means is further provided for eliminating backlash of the platen gear when the cover is closed.

According to the present invention, the platen roller is arranged downstream of the sprocket. This enables elimination of backlash of the platen gear when the cover is closed and reduces the blank space.

BRIEF DESCRIPTION OF THE DRAWINGS

FIG. 15B shows a state when a character printing of a second color has been completed, and FIG. 15C shows a state when the sheet has been fed backward by a predetermined amount.

DETAILED DESCRIPTION OF PREFERRED EMBODIMENTS

Description will now be directed to a printer according to an embodiment of the present invention with reference to the attached drawings.

Figure 1:
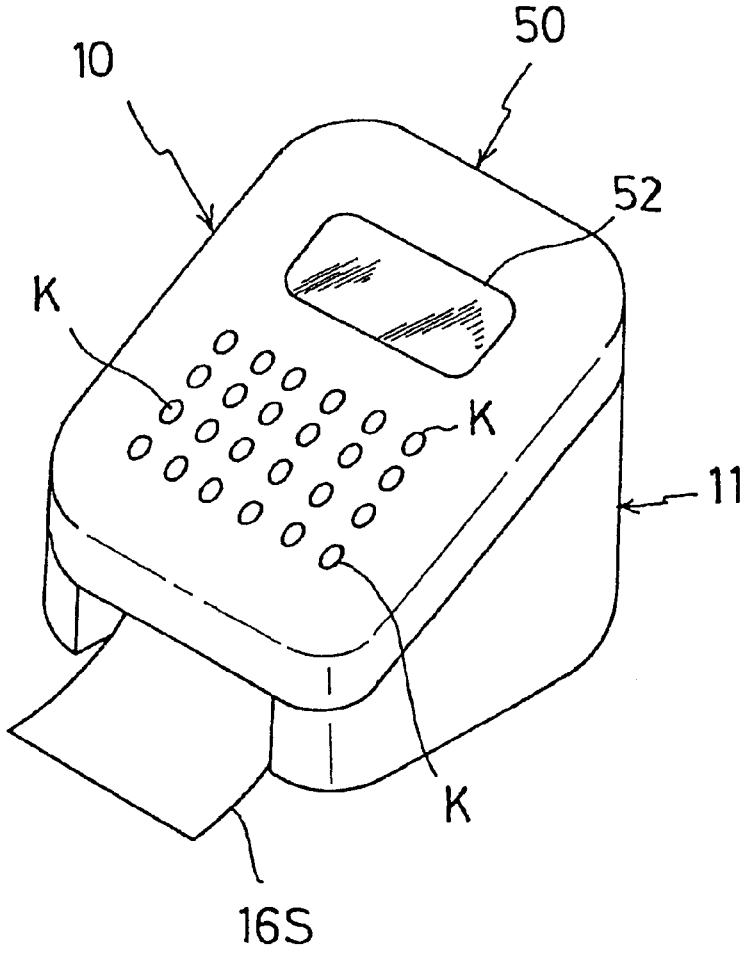
FIG. 1 is a perspective external view of a printer according to the present invention.
Figure 2:
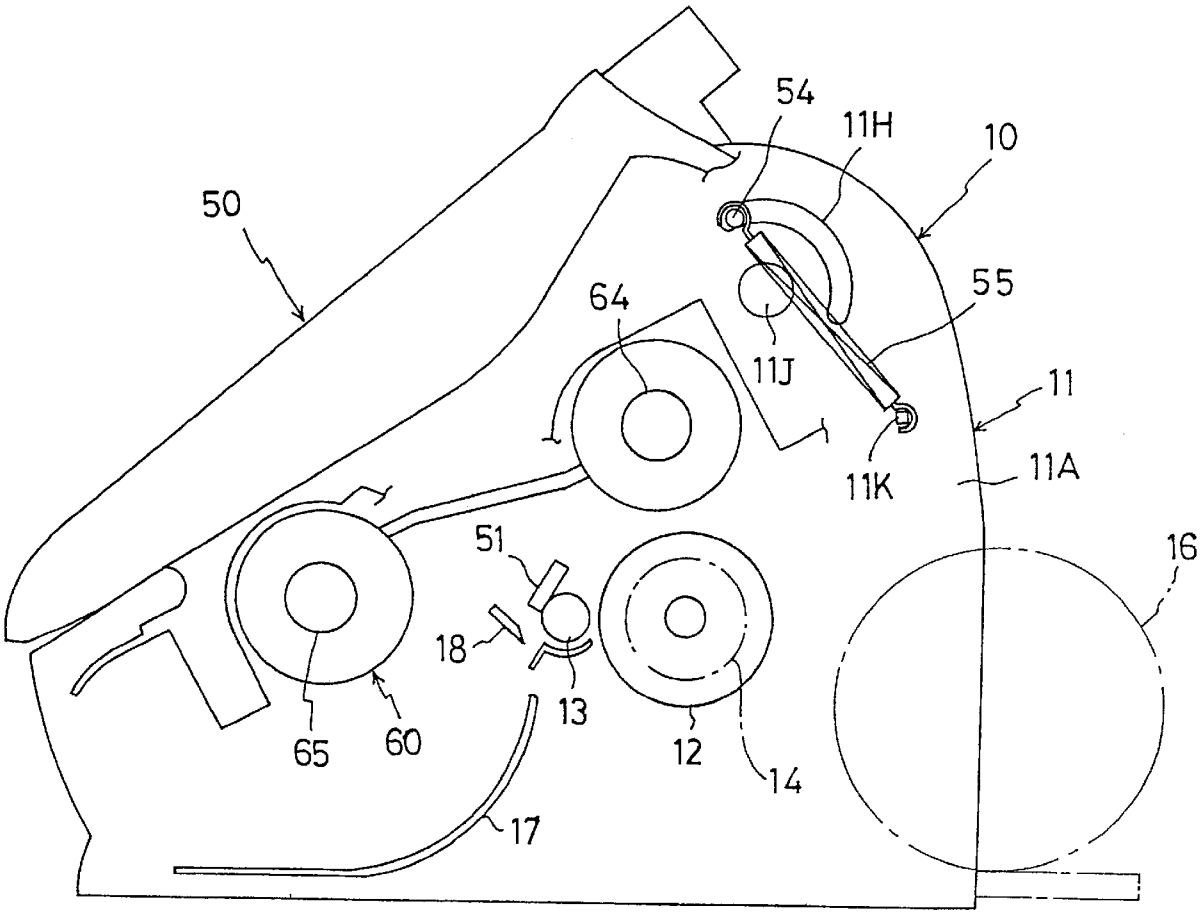
FIG. 2 shows arrangement of main component of the printer.
Figure 3:
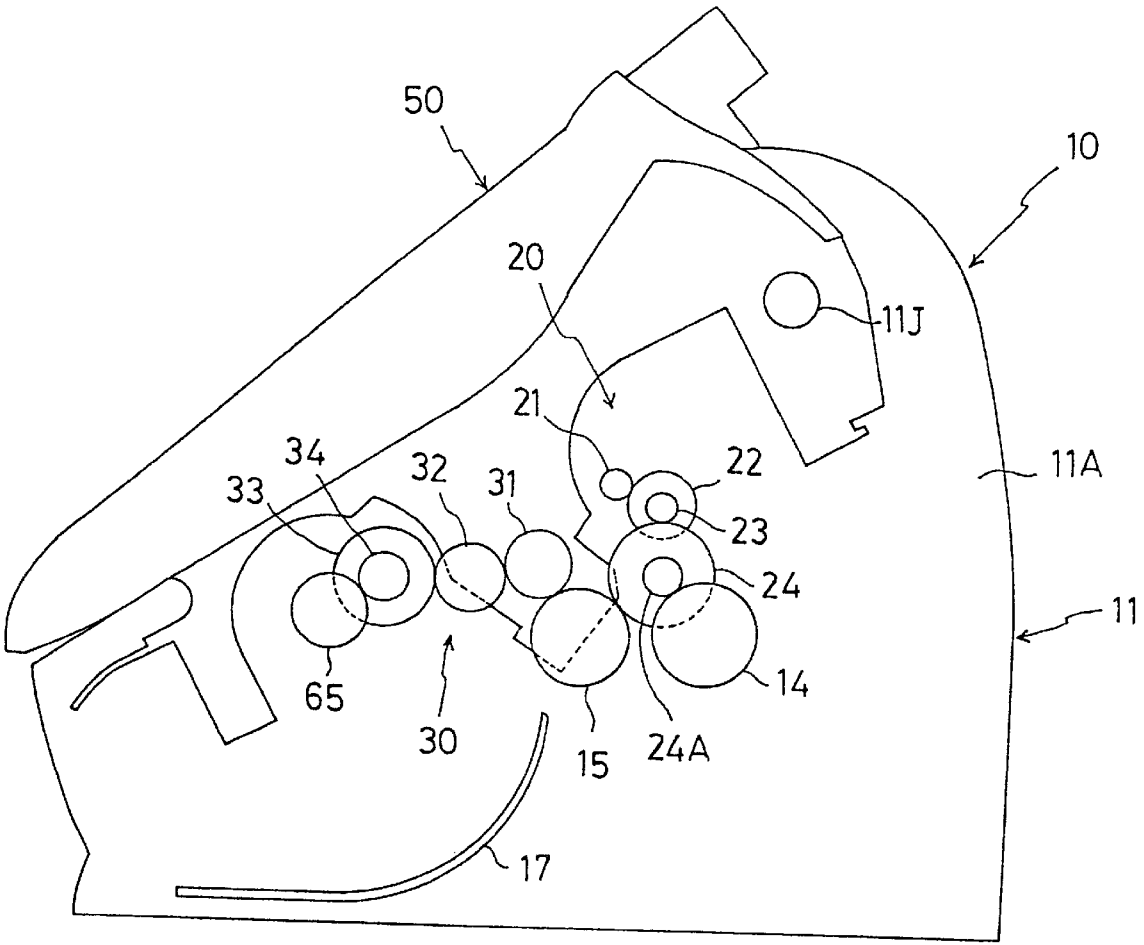
FIG. 3 shows arrangement of gears used in the printer.

A printer 10 shown in FIG. 1 to FIG. 3 includes a printer main body 11 and a cover 50 mounted on the printer main body 11 in such a manner that the cover 50 can be opened and dosed.

In the printer main body 11, there are arranged a sprocket 12, a platen roller 13, a driving gear mechanism 20 for rotating the sprocket 12 and the platen roller 13, a gear mechanism 30 for rotating a ribbon core (See FIG. 8) of an ink ribbon cassette 60 which will be detailed later, and a cutter 18 for cutting a sheet. The platen roller 13 has a circumferential speed set slightly faster than a circumferential speed of the sprocket 12.

Figure 4:
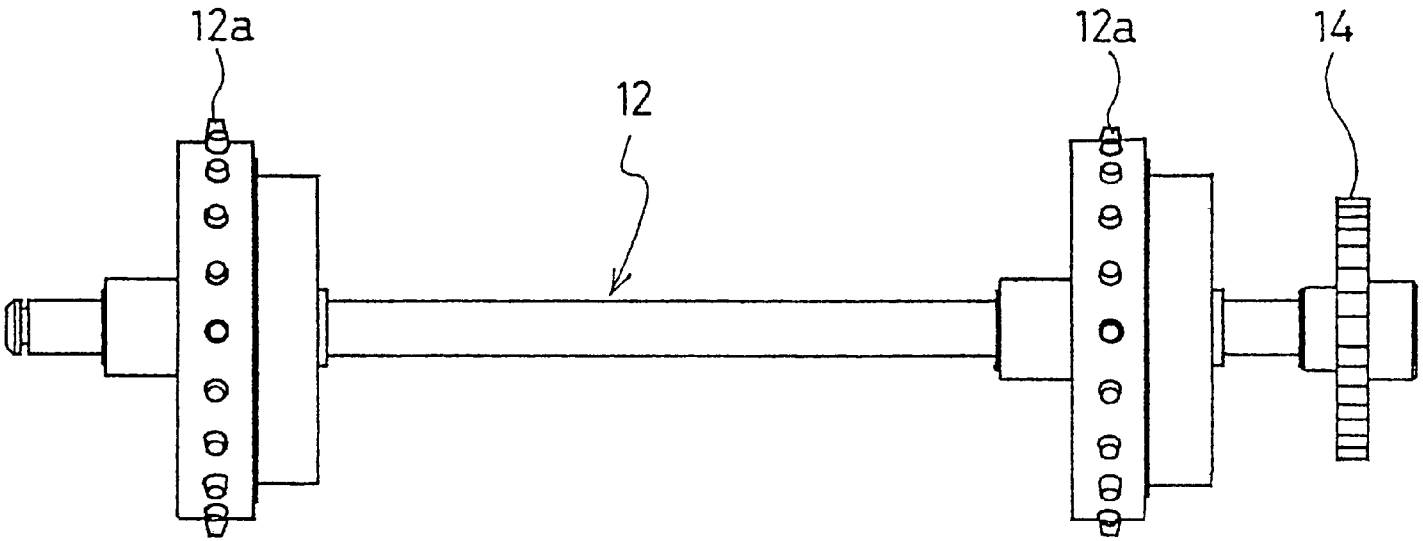
FIG. 4 is a front view of a sprocket used in the printer.
Figure 5:
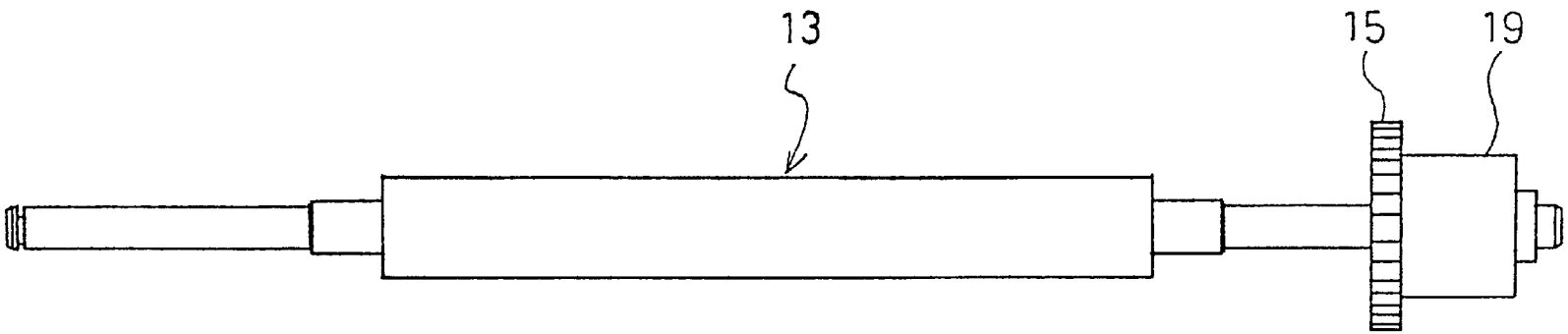
FIG. 5 is a front view of a platen roller used in the printer.

As shown in FIG. 4, a sprocket gear 14 is ranged on the sprocket 12. As shown in FIG. 5, a platen gear 15 and a torque limiter 19 are ranged at one end of the platen roller 13. When a load exceeding a predetermined value is applied tot he platen roller 13, the torque limiter 19 makes the platen gear 15 idle against the platen roller 13. Moreover, a sheet roll 16 can be arranged at a rear portion of the printer main body 11. A sheet 16S which will be detailed later is wound on the sheet roll 16. The sheet 16S has feed holes (not depicted) at both sides thereof and the sprocket 12 has protrusions 12*a* to be engaged with the feed holes. A reference symbol 17 is a guide member for guiding a printed sheet portion forward.

The driving gear mechanism 20 includes a drive gear 21 arranged on a drive shaft 53*a* of a stepping motor 53 which will be detailed later, a gear 22 engaged with the drive gear 21, a gear 23 arranged on this gear 22, a gear 24 engaged with the gear 23, and a gear 24A arranged on the gear 24. The gear 24A is engaged with a sprocket gear 14 while the gear 24 is engaged with a gear 15.

The gear mechanism 30 includes a gear 31 engaged with the platen gear 15, a gear 32 engaged with the gear 31, a gear 33 engaged with the gear 32, and a gear 34 arranged on the gear 33. The gear 34 is engaged with a core gear 65 which will be detailed later.

An arc-shaped prolonged hole 11H is provided on two side plates 11A of the printer main body 11, i.e., at a position above a shaft 11J. A pin 54 provided on the cover 50 is inserted into the prolonged holes 11H in such a manner that the pin 54 can move along the prolonged holes 11H. The spring 55 has one end attached to the pin 54 and the other end attached to an engagement portion 11K provided on the printer main body 11. The cover 50 is always urged by the spring 55 to an open-state direction. Because of this urging force, the cover 50 will not be dosed with bump by its weight when dosing the cover 50.

Figure 7:
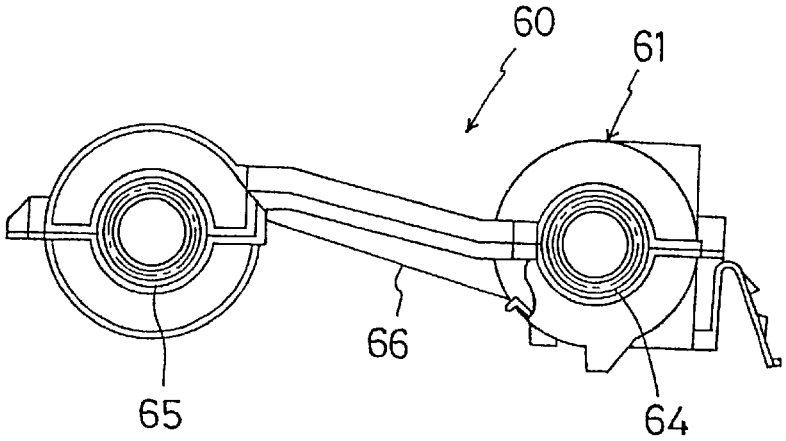
FIG. 7 is a side view of an ink ribbon a cassette used in the printer.
Figure 8:
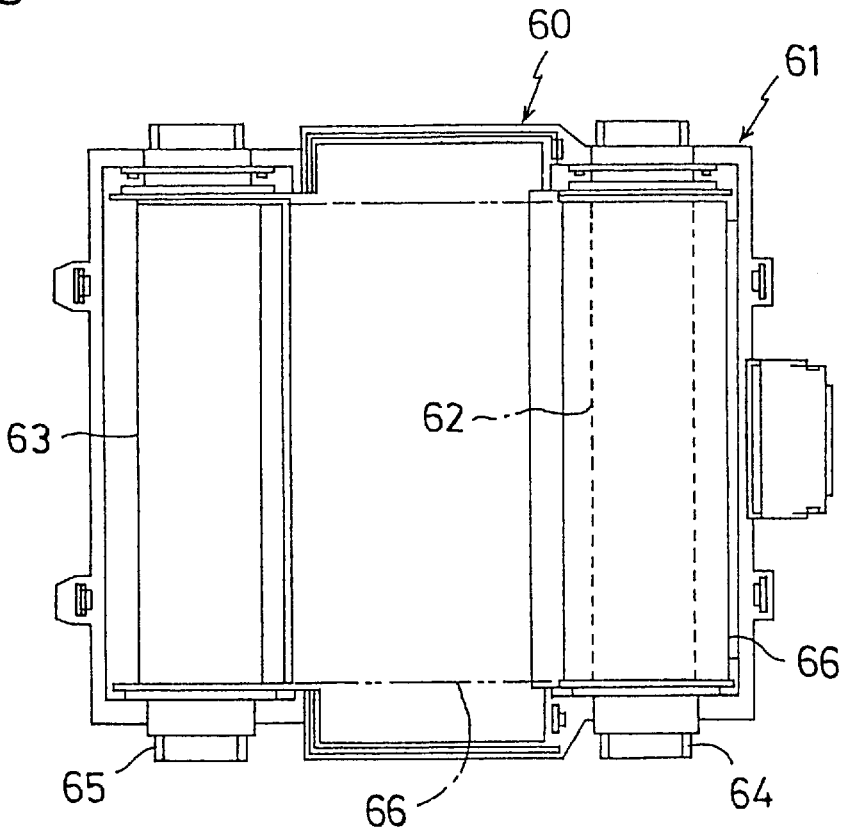
FIG. 8 is a plan view of the ink ribbon cassette when its cover is removed.

As shown in FIG. 7 and FIG. 8, the ink ribbon cassette 60 has ribbon cores 62 and 63 arranged in a cassette 61 and core gears 64 and 65 mounted on the ribbon cores 62 and 63. An ink ribbon 66 is wound on the ribbon core 62 and this ink ribbon 66 is wound up onto the ribbon core 63.

Figure 9:
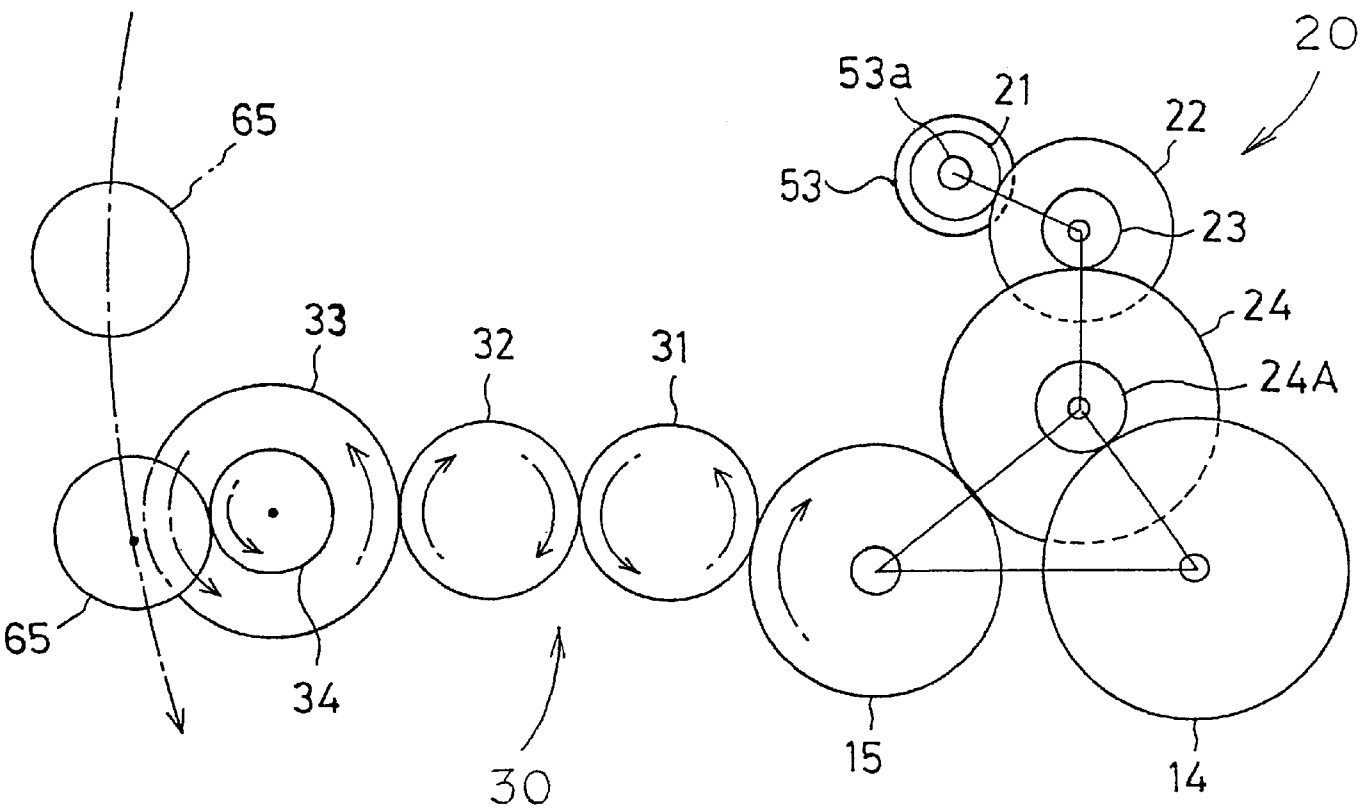
FIG. 9 shows engagement relationships between respective gears.
Figure 10:
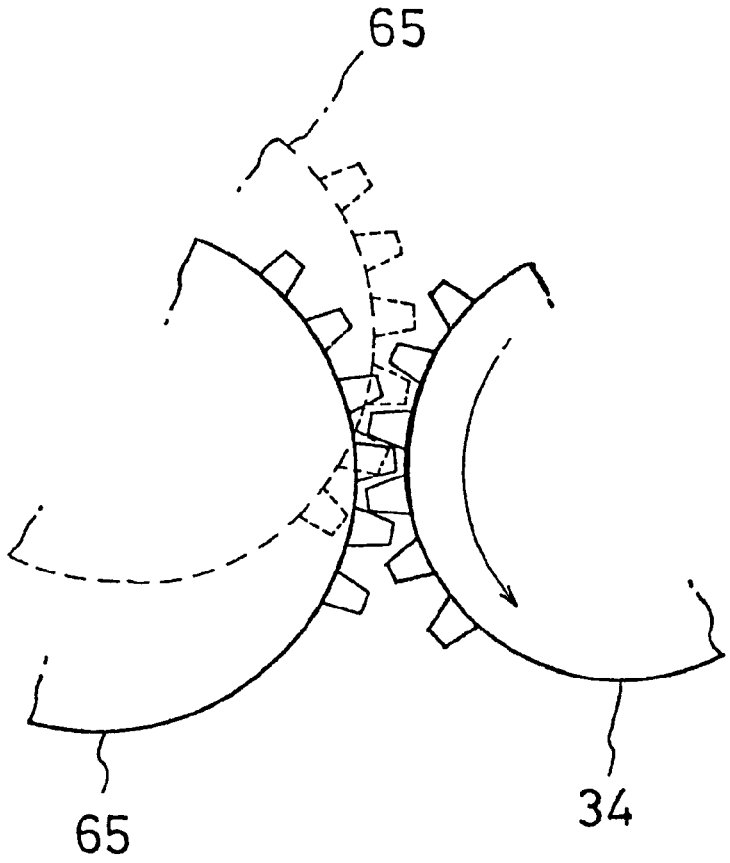
FIG. 10 shows engagement relationships between gears.
Figure 11A:
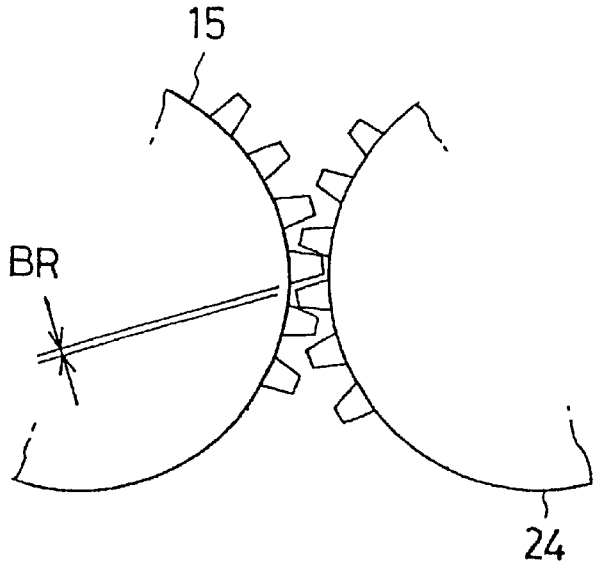
FIG. 11A shows a state of backlash.
Figure 11B:
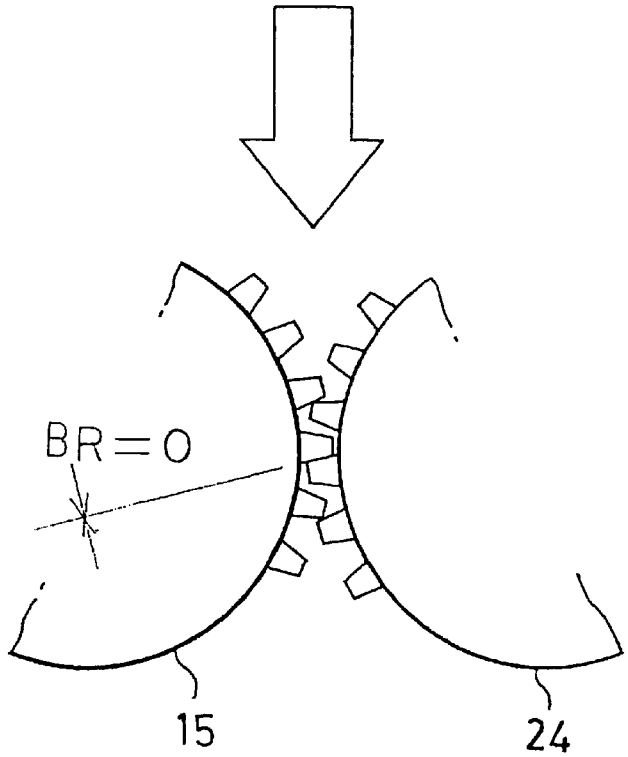
FIG. 11B shows a state where backlash is eliminated.

When the cover 50 is opened, the core gear 65 of the ink ribbon cassette 60 is disengaged from the gear 34 and when the cover 50 is dosed, the core gear 65 of the ink ribbon cassette 60 is engaged with the gear 34. As shown in FIG. 9, the core gear 65 has its center located at a position slightly lower than the center position of the gear 34. Here, as shown in FIG. 10, the gear 34 is slightly rotated counterclockwise by the core gear 65. This rotation rotates the gears 32, 31, and 15 in directions indicated by arrow in FIG. 9. By this, backlash BR present between the platen gear 15 and the gear 24 shown in FIG. 11A is eliminated as shown in FIG. 11B.

Figure 12:
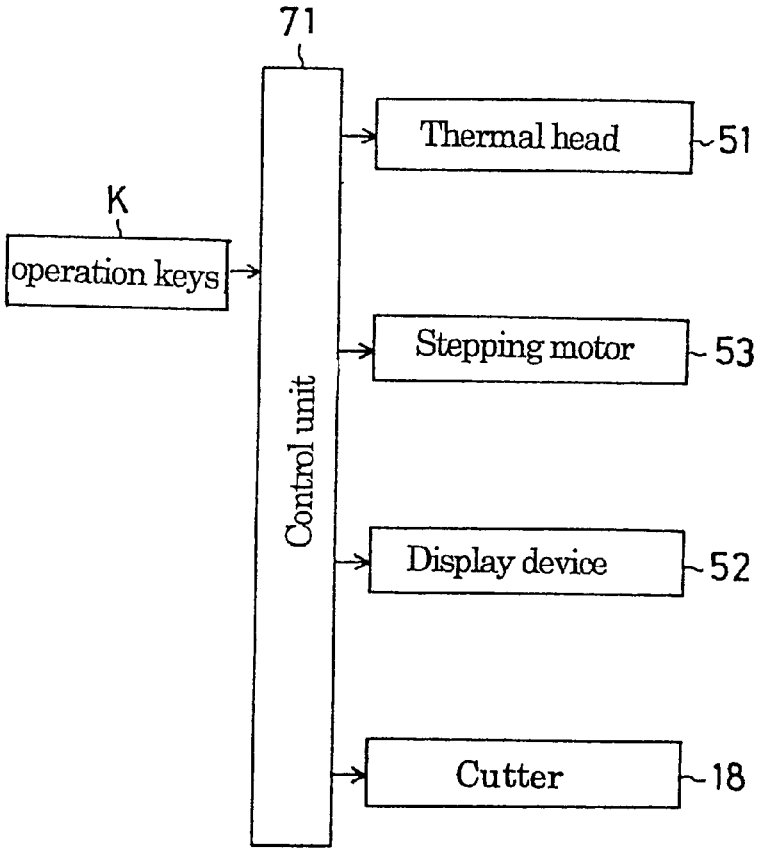
FIG. 12 is a block diagram showing configuration of a control system of the printer.

FIG. 12 is a block diagram showing configuration of a control system of the printer 10. In FIG. 12, the control system includes a control unit for controlling the thermal head 51, a display device 52, the stepping motor 53, and the cutter 18 according to operation of keys K. This control unit 71 is composed of a CPU and the like and has a function of preparatory feed means for preparatory feed of the sheet by L1 (first predetermined amount), a function of empty feed means for empty feed of the sheet L2 which has been fed in advance, by L2 (second predetermined amount), and a function of backward feed means for feeding back the sheet by the total length of the preparatory feed amount, the empty feed amount, and the actual printing range.

Next, explanation will be given on operation of the printer according to the aforementioned embodiment.

Figure 6:
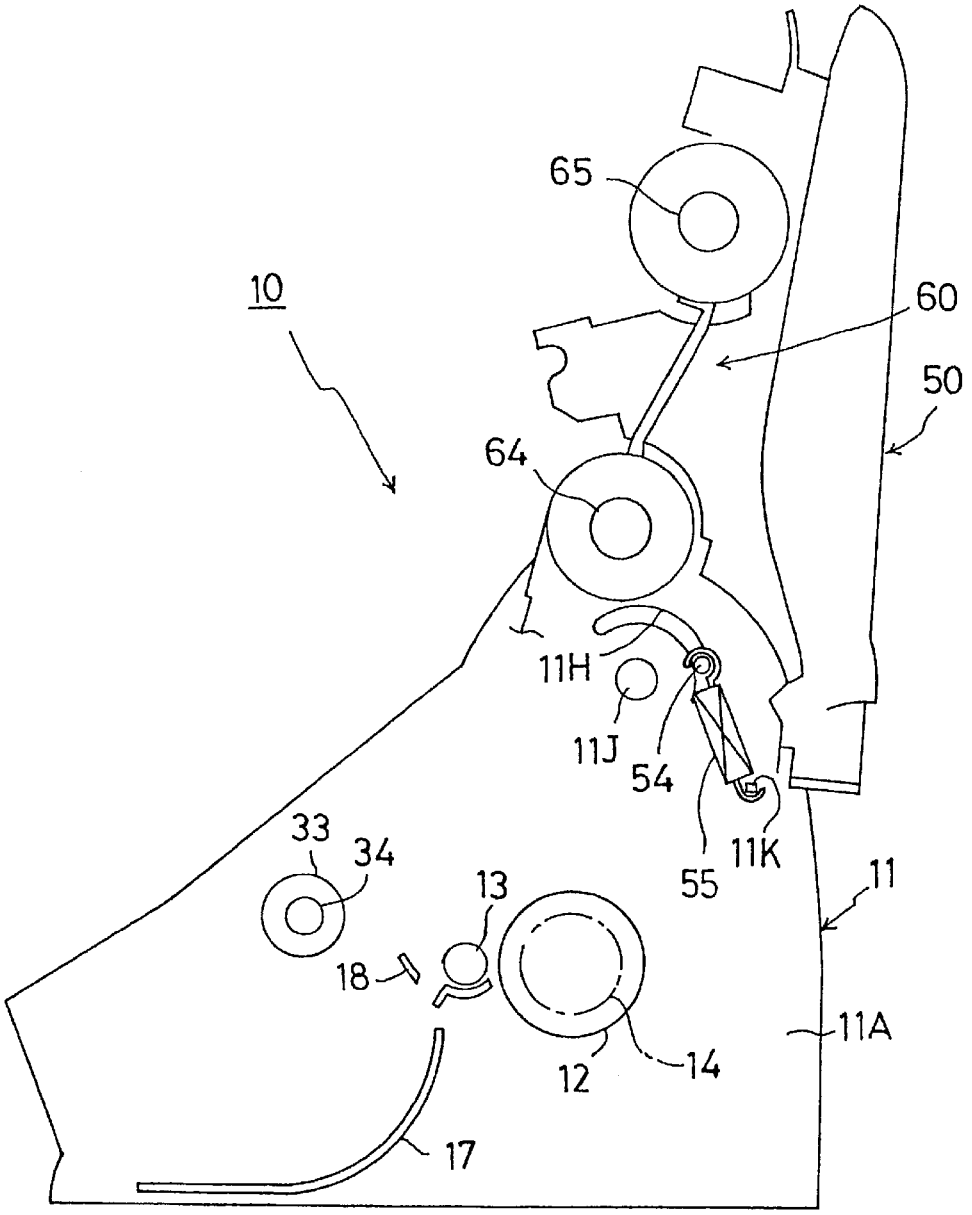
FIG. 6 shows configuration of the printer when a cover of the printer is opened.

Firstly, as shown in FIG. 6, the cover 50 is opened, the ribbon cassette 60 is mounted on the cover 50, and the cover 50 is dosed. When the cover 50 is dosed, the core gear 65 slightly rotates the gear 34 counterclockwise, thereby eliminating the backlash B of the platen gear 15. Here, the sheet roll 16 is already set on the printer main body 11 and the previous printing has been completed and the sheet 16S has been cut by the cutter 18. Accordingly, as shown in FIG. 13A, it is assumed that the leading edge 16*a* of the sheet 16S is located at the position of the cutter 18.

Next, operation key K are operated to enter a desired character and the like. The characters and the like entered are displayed on the display device 52. When printing is started by operating the operation keys K, the control unit 71 rotates the stepping motor 53. Rotation of the stepping motor 53 rotates via the drive mechanism 20 the platen roller 13 and the sprocket 12, thereby feeding the sheet 16S from the sheet roll 16.

Here, since the backlash is eliminated, there is no danger of rotation of the sprocket 12 prior to the platen roller 13. Thus, it is possible to prevent generation of loosening of the sheet 16S by the backlash BR between the platen roller 13 and the sprocket 12.

Figure 13:
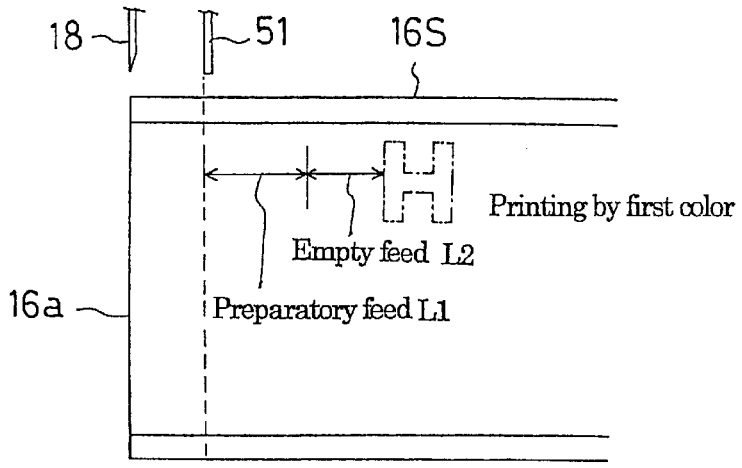
FIG. 13A shows a positional relationship between a sheet, a cutter, and a thermal head.
FIG. 13B shows a state where the sheet has been fed by preparatory feed.
FIG. 13C shows a state when the sheet has been fed by empty feed.
Figure 13:
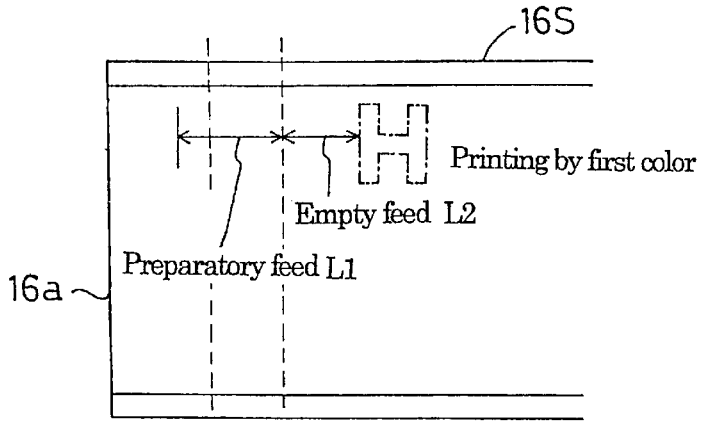
Figure 13:
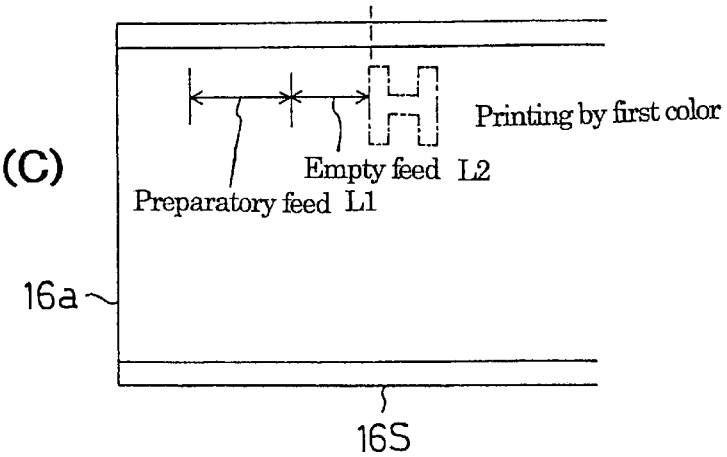

As shown in FIG. 13B, feeding out of the sheet 16S is performed firstly as a preparatory feed of length L1. This preparatory feed can eliminate the possible loosening of the sheet 16S caused by a factor other than the backlash BR between the platen roller 13 and the sprocket 12. This is because the circumferential speed of the platen roller 13 is set faster than the circumferential speed of the sprocket 12.

Moreover, the preparatory feed can make the engagement between the gears 22, 23, 24, and 14 constant. That is, it is possible to eliminate backlash of these gears 22, 23, 24, and 14.

Next, as shown in FIG. 13C, empty feed of length L2 is performed. The preparatory feed and the empty feed are performed by counting pulses to the stepping motor 53. After this empty feed, printing is performed by the thermal head 51 on the sheet 16S.

Thus, since loosening of the sheet 16S due to backlash BR is prevented and the preparatory feed is performed prior to the empty feed, it is possible to surely eliminate loosening of the sheet 16S and to obtain constant engagement between the respective gears. Accordingly, it is possible to perform printing accurately at a predetermined position.

Figure 14:
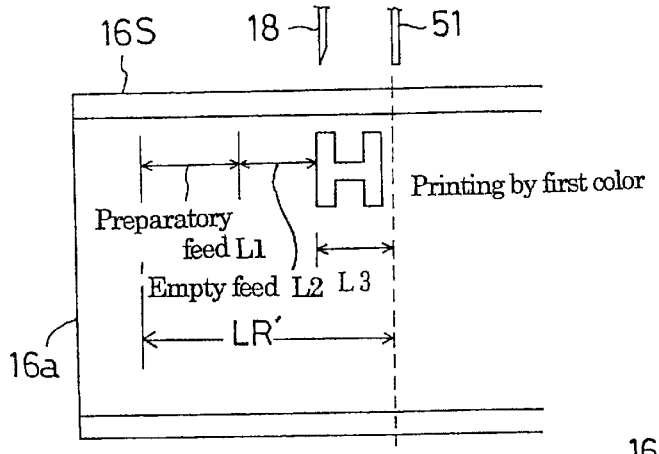
FIG. 14A shows a state when a character printing of a first color has been completed.
FIG. 14B shows a state when the sheet has been fed backward by a predetermined amount.
FIG. 14C shows a state when the sheet has been fed by preparatory feed.
Figure 14:
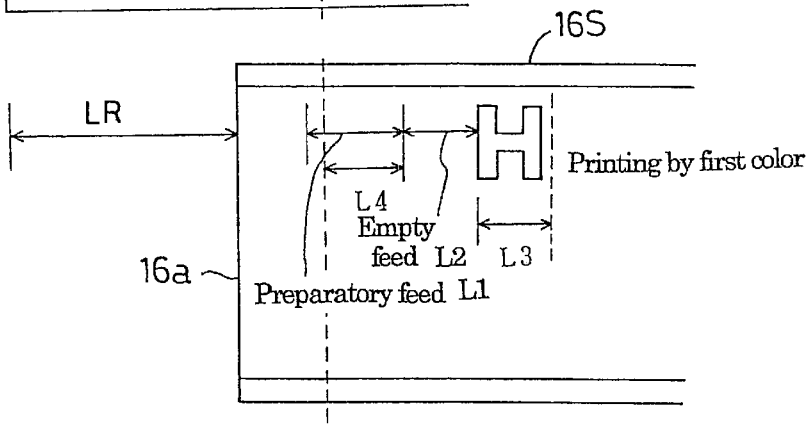
Figure 14:
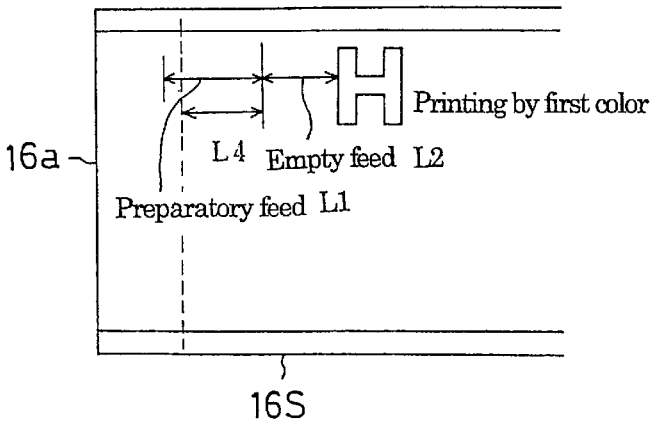

As shown in FIG. 14A, upon completion of printing, drive of the stepping motor is stopped. After this, the stepping motor 53 is rotated in a backward direction, so that the sheet 16S is fed backward as shown in FIG. 14B. The backward feed length LR is defined by the total of the preparatory feed length L4 performed for the second color and after, the empty feed length L2, and the sheet feed length L3 upon printing. The backward feed length is determined by counting pulses to the stepping motor 53.

Figure 15:
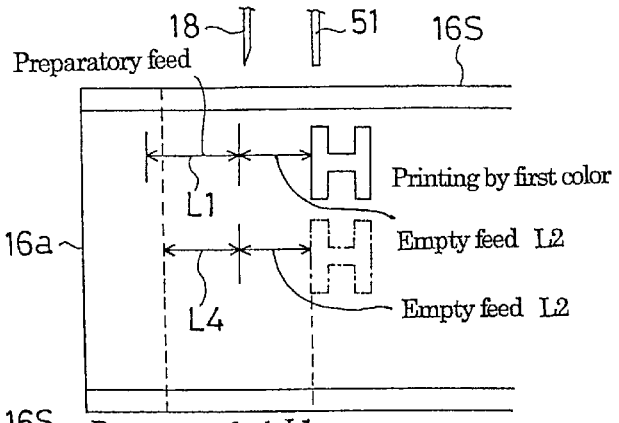
FIG. 15 shows a state when the sheet has been fed by empty feed from the state of FIG. 14C.
Figure 15:
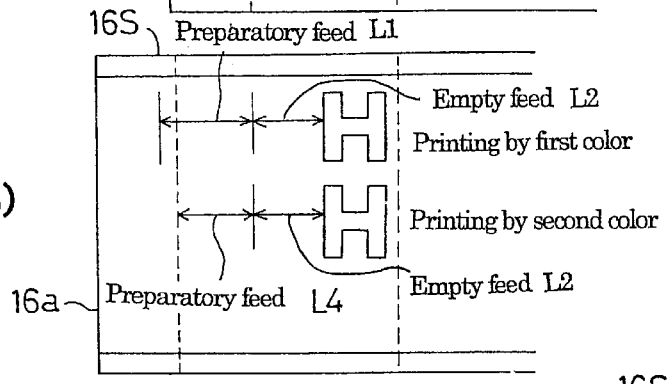
Figure 15:
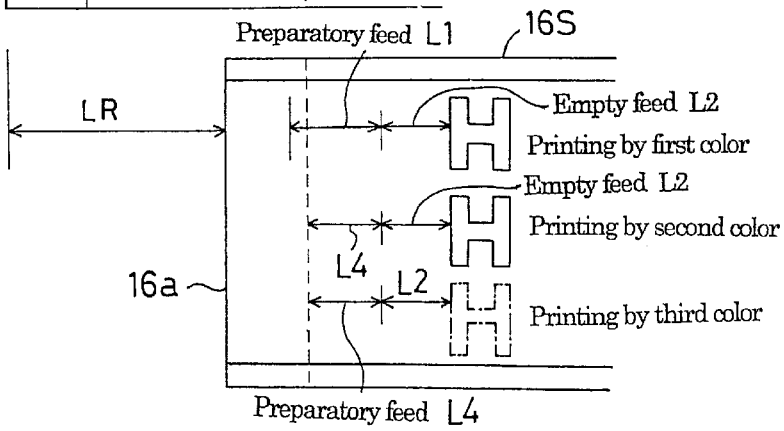
Figure 16:
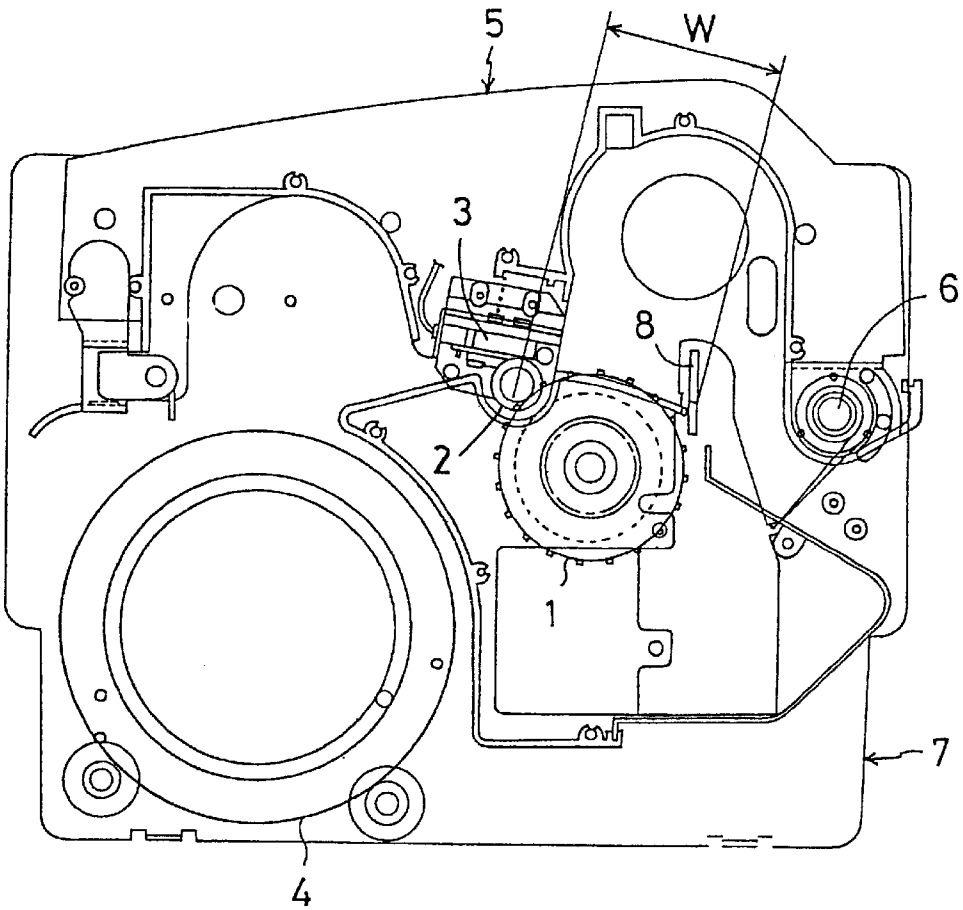
Fig. 16 PRIOR ART
FIG. 16 shows configuration of a conventional printer

When the sheet 16S is fed backward by the length LR, the backward rotation of the stepping motor is stopped. After this, the stepping motor 53 is driven to rotate in forward direction and as shown in FIG. 14C, the sheet 16S is fed by the length L4 as the preparatory feed. Then, as shown in FIG. 15A, empty feed is performed by the length L2. After this, as shown in FIG. 15B, printing of the second color is performed.

Upon this printing of the second color as well the preparatory feed is performed to correct the loosening of the sheet 16S and engagement between the respective bears to be constant. Accordingly, it is possible to feed the sheet 16S in such a manner that a character printed by the first color comes to the position of the thermal head 51. Thus, it is possible to perform printing of the second color accurately on the character printed by the first color. Thus, it is possible to prevent printing by different colors at different positions.

As shown in FIG. 14B, upon completion of printing of the fist color, the sheet 16S is to be fed backward by the length LR' (L1+L2+L3). However, the actual backward feed length is the length deleted by the backlash amounts (maximum total backlash Ba) of the respective gears 22 to 24A, i.e., LR=LR'−Ba. Upon printing of the second color, the length LR'−Ba, i.e., a value deleted by the total backlash Ba of the respective gears 22 to 24A is actually fed out. Accordingly, there is no affect of backlash.

As shown in FIG. 15B, upon completion of the second color, the sheet 16S is fed backward by the length LR as shown in FIG. 15C. In the same way as the aforementioned, the preparatory feed and the empty feed are performed before performing printing of the third color. This printing of the third color is also performed accurately at the position of the second color. Thus, there is no danger that different colors are printed at different positions.

According to this embodiment, the platen roller 13 is arranged downstream of the sprocket 12 and accordingly, it is possible to reduce the distance between the platen roller 13 and the cutter 18. Therefore, it is possible to reduce the blank space between the leading edge of the sheet 16S and the position where a character is printed.

Moreover, according to this embodiment, the torque limiter 19 is provided between the platen roller 13 and the platen gear 15. Accordingly, when a load exceeding a predetermined value is applied to the platen roller 13, the platen gear 15 runs idle against the platen roller 13. Thus, it is possible to feed the sheet 16A while applying a predetermined tension between the platen roller 13 and the sprocket 12.

In the aforementioned embodiment, when the cover is closed, the core gear 65 of the ink ribbon cassette 60 is engaged with the gear 34 so as to prevent generation of backlash BR. It is also possible to correct loosening of the sheet 16S by the preparatory feed alone prior to the empty feed without preventing generation of the backlash BR.

As has been described above, according to the present invention, it is possible to reduce the blank space and eliminate the backlash.

What is claimed is:

1. A printer comprising a printer main body, a cover arranged on the printer main body in such a manner that the cover can be opened, a sprocket for feeding a sheet from a sheet roll arranged in the printer main body, a platen roller and a printing head for printing on the sheet, a driving gear mechanism for rotating the sprocket and the platen roller, a gear mechanism for rotating a ribbon core of an ink ribbon cassette mounted on the cover using the driving gear mechanism, and backlash eliminating means for eliminating backlash of the platen gear when the cover is closed.

2. The printer as claimed in claim 1, wherein the backlash eliminating means includes a core gear for the ribbon core, which core gear is engaged with a gear of the gear mechanism when the cover is closed, thereby slightly rotating the gear of the gear mechanism in a reverse direction, so as to eliminate backlash of the platen gear.

3. The printer as claimed in claim 2, wherein the sheet is preparatively fed by a predetermined amount and then the driving gear mechanism is driven, prior to empty feed of the sheet before starting printing.

4. A printer comprising a printer main body, a cover arranged on the printer main body in such a manner that the cover can be opened, a sprocket for feeding a sheet from a sheet roll arranged in the printer main body, a platen roller and a printing head for printing on the sheet, a driving gear mechanism for rotating the sprocket and the platen roller, and a gear mechanism for rotating a ribbon core of an ink ribbon cassette mounted on the cover using the driving gear mechanism, the printer further comprising preparatory feed means for feeding the sheet by a first predetermined amount as a preparatory feed and empty feed means for feeding the sheet by a second predetermined amount before starting printing.

5. The printer as claimed in claim 4, the printer further comprising backward feed means for feeding backward the sheet by a total length of the preparatory feed amount, the empty feed amount, and an actual printing range.

6. The printer as claimed in claim 1, further comprising preparatory feed means for feeding the sheet by a first predetermined amount as a preparatory feed and empty feed means for feeding the sheet by a second predetermined amount before starting printing.

7. The printer as claimed in claim 6, the printer further comprising backward feed means for feeding backward the sheet by a total length of the preparatory feed amount, the empty feed amount, and an actual printing range.

8. The printer as claimed in claim 4, wherein the ribbon core includes a core gear that is engaged with and slightly rotates a gear of the gear mechanism in a reverse direction when the cover is closed so as to eliminate backlash of the platen gear.

9. A printer comprising a printer main body, an openable cover arranged on the printer main body, a sprocket for feeding a sheet from a sheet roll arranged in the printer main body, a platen roller and a printing head for printing on the sheet, a drive mechanism for driving rotation of the sprocket and the platen roller, a rotating mechanism for rotating a ribbon core of an ink ribbon cassette mounted on the cover using the drive mechanism, and a backlash eliminating mechanism cooperating with said rotating mechanism for eliminating backlash of the platen gear when the cover is closed.

10. The printer as claimed in claim 9, wherein the backlash eliminating mechanism includes a core gear for the ribbon core which is engaged with said rotating mechanism when the cover is closed, said drive mechanism driving said rotating mechanism engaged with said core gear in a reverse direction so as to eliminate backlash of the platen gear.

11. The printer as claimed in claim 9, further comprising a motor mechanism for feeding the sheet by a first predetermined amount as a preparatory feed and for feeding the sheet by a second predetermined amount before starting printing.

12. The printer as claimed in claim 11, wherein said motor mechanism feeds backward the sheet by a total length of the preparatory feed amount, the empty feed amount, and an actual printing range.

* * * * *